343-909 SR
1/13/87 XR 4,636,797

United States Patent [19]

Saffold et al.

[11] Patent Number: 4,636,797

[45] Date of Patent: Jan. 13, 1987

[54] DUAL MODE DICHROIC ANTENNA/APERTURE

[75] Inventors: James A. Saffold; Augustus H. Green, Jr.; Ronald C. Passmore, all of Huntsville, Ala.

[73] Assignee: The United States of America as represented by the Secretary of the Army, Washington, D.C.

[21] Appl. No.: 708,123

[22] Filed: Mar. 4, 1985

[51] Int. Cl.[4] ..... H01Q 21/28; H01Q 19/18

[52] U.S. Cl. ..... 343/725; 343/781 CA; 343/909

[58] Field of Search ..... 343/721, 725, 781 CA, 343/909

[56] References Cited

U.S. PATENT DOCUMENTS 3,698,001 10/1972 Koyama et al. ..... 343/779
4,282,527 8/1981 Winderman et al. ..... 343/781 CH
4,573,054 2/1986 Bouko et al. ..... 343/909

*Primary Examiner*—Eli Lieberman
*Attorney, Agent, or Firm*—John C. Garvin, Jr.; Freddie M. Bush

[57] ABSTRACT

A dual mode antenna that allows both millimeter wave radiated energy and infrared radiated energy to enter a single aperture and propagate through a common transmission device to a point where the respective energies are divided to follow separate paths for subsequent processing. An electromagnetic transmission guide for waveguide comprises first and second parallel tubular members having beam directing reflectors and lenses therein for maintaining low-loss, gaussian beam propagation of radiated energy therethrough. Cassegrainian optics of a cassegrainian antenna system are positioned for directing the millimeter and infrared energy into a common, circular end of said tubes where the energy impinges on beam directing means that separates the respective energies, directing them into the respective parallel tubes along two separate and distinct paths.

6 Claims, 4 Drawing Figures

DUAL MODE DICHROIC ANTENNA/APERTURE

DEDICATORY CLAUSE

The invention described herein may be manufactured, used, and licensed by or for the Government for governmental purposes without the payment to us of any royalties thereon.

BACKGROUND OF THE INVENTION

In higher frequency sensor technology wherein antenna or aperture systems are disposed for intercepting infrared or millimeter wave radiated energy, most sensors operate in either the infrared domain or the millimeter domain but not in both domains simultaneously. Thus, for a tracking or receiving system to detect intelligent electromagnetic radiation in these frequency bands, separate and distinct antenna or aperture systems are required.

SUMMARY OF THE INVENTION

A dual mode antenna/aperture system allows both millimeter wave and infrared wave energies to enter a detection system by way of a single antenna or aperture and propagate through a common transmission device to a point of separation where the energies are divided into independent channels for subsequent coupling to routine signal processing circuitry. This system uses well established cassegrainian optics for directing incident energy into an electromagnetic transmission guide that contains a dichroic beam splitter. The dichroic beam splitter separates infrared from millimeter wave energy by directional reflection of infrared wavelengths while maintaining high transmission and low depolarization of millimeter wave transmission passing therethrough.

DESCRIPTION OF THE PREFERRED EMBODIMENT

Figure 1:
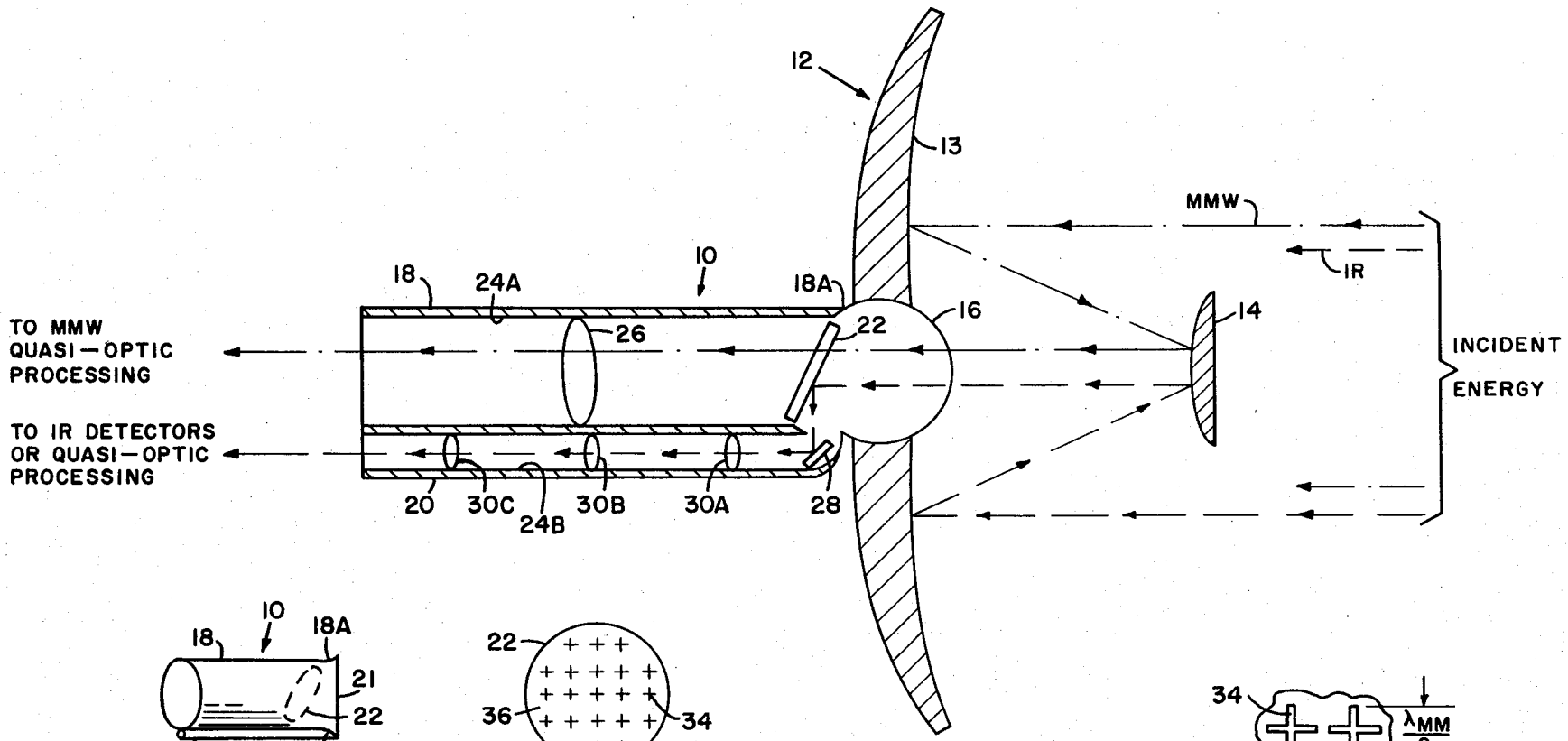
FIG. 1 is a schematic diagram of a preferred embodiment of the dual mode dichroic antenna/aperture.

Referring now to the drawings wherein like numbers represent like parts, the preferred embodiment of the antenna/aperture system is shown in schematic form, in FIG. 1. Support structures are well established for optical and electromagnetic signal processing components and, as such, are not shown since they do not contribute to an understanding of the invention. As shown in FIG. 1, the electromagnetic transmission guide 10 is coupled to a cassegrainian antenna system for receiving incident energy therefrom. In the cassegrainian antenna system 12 a primary reflector 13 and a secondary reflector 14 are shown for directing incoming incident energy into the electromagnetic transmission guide 10. Reflectors 13 and 14 are machined to strict surface roughness tolerances. Subreflector 14 is hyperbolic. Particular limits on surface roughness of the reflectors depend on the particular type of antenna material used. Generally speaking, sigma ($\sigma$) is the RMS deviation of the reflector surface from an ideal paraboloid; and the maximum deviation from the ideal parabolic profile should be $\pm\lambda/32$, where $\lambda$ is the wavelength of the highest frequency used.

A standard energy collecting radome 16 is disposed in an aperture of primary reflector 13 through which incident energy is passed into the electromagnetic guide 10. Typically, transmission properties such as low loss tangent, non-depolarizing, and low transmission loss are required for the waveguide to satisfactorily pass both millimeter wavelength and infrared wavelength. Structural properties of the radome 16, typically, are hardness and low water solubility. Reflectors, radomes and their construction criterion are discussed extensively in Chapters 10 and 14 respectively of the "Radar Handbook" by M. I. Skolnik published by McGraw-Hill Book Company in 1970, and in technical report TR-RE-84-21, "Preliminary Assessment of Dual-Mode Millimeter Infrared Sensor Feasibility", authored by James A. Saffold, one of the co-inventors of the subject invention. This report, dated August 1984, was published by the U. S. Army Missile Command, Redstone Arsenal, Ala. Magnesium flouride, polydivinylbenzene, and monochlorotrifloroethylene are typical radome materials which include the desired transmission properties and structural properties.

Electromagnetic transmission guide 10 comprises two circular or cylindrical tubes 18 and 20. Tube 18 includes a dichroic beam splitter 22 which may be planar or hyperbolic in contour and is positioned at an end 18A of tube 18 for receiving incident radiation upon passage of the radiation through the radome 16 and as it enters tube 18. Tubes 18 and 20 further include an inner surface coating of polished aluminum 24A and 24B respectively for enhancing good propagation performance in both the millimeter wave (MMW) and infrared wave (IR) paths. Tube 18 functions as the millimeter wave path by coupling incident millimeter wave energy, which passes through the dichroic beam splitter 22, into millimeter wave quasi-optic processing circuitry for routine signal processing. The processing circuitry is not shown. Similarly, the infrared path is through tube 20, incident infrared energy being reflected from dichroic beam splitter 22 into tube 20 and being guided therethrough for further coupling to infrared detectors or quasi-optic processing (not shown).

The millimeter wave path through tube 18 utilizes well known gaussian beam propagation techniques for millimeter wave radiation and is physically a much larger diameter path for radiation than that of the smaller diameter path for infrared energy provided by tube 20. The criteria for good gaussian propogation of energy through a lens is that the ratio of the lens diameter to the wavelength used is 10. Therefore the diameter of the MMW lenses are larger than the IR lenses by $\lambda_{MMW}/\lambda_{IR}$. A lens element 26 maintains desirable transmission characteristics within the tube 18 at millimeter energies and focuses or directs the energy into the quasi-optical millimeter wave processing circuitry. There are numerous established methods of processing and/or duplexing this energy and the optimum choice of processing circuitry depends upon individual system application and is not pertinent to the scope of this invention.

Incident infrared energy, reflected by beam splitter 22, impinges on a reflecting mirror 28 having a high surface roughness tolerance restriction which reflects the infrared energy through the infrared transmission path of tube 20. Elements 30 A, B, and C are lenses in the transmission path of tube 20. These lenses are confocal and are anti-reflection coated to provide low loss and gaussian beam propagation of the infrared energy through the tube. Quasi-optical propagation uses optical techniques for energies that are not in the optical band and propagation of infrared energy with this technology is well known. Lenses 30 may be lenses that can be automatically compensated for two color IR, using lens shaping to reduce chromatic aberration in the lens' focal plane.

Figure 2:
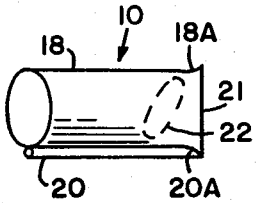
FIG. 2 is a perspective view of the electromagnetic transmission guide of FIG. 1.

As shown in the perspective view of FIG. 2, transmission guide 10 has the beam splitter 22 (shown in dashed lines) positioned adjacent end 18A for receiving the incoming energy. End 18A is slightly flared or widened. This widened section allows the incoming infrared energy to be readily directed into the transmission path through tube 20. The widened section, which is only about 1 millimeter wider than the main body of tube 18, is readily visualized by comparison to a copper tube flared at one end for mating to another tube. This slight widening allows the end 18A of tube 18 to merge together with end 20A of tube 20 and be formed into a common receiving end of the composite tube and having a circular cross-section.

Figure 4:
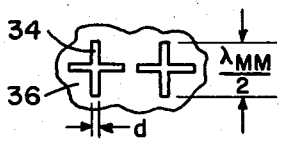
FIG. 4 is an enlarged sectional view of the dichroic element of FIG. 3 showning details of the multiple apertures therein.
Figure 3:
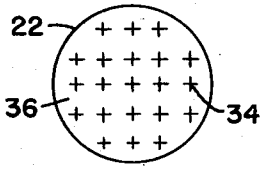
FIG. 3 is a plane view of the dichroic element for separating the two beams.

A typical dichroic beam splitter is shown in more detail in FIG. 3. Beam splitter 22 reflects the infrared wavelength while maintaining effective transmission of the millimeter wavelength. Beam splitter 22 may be a planar, circular structure as shown in FIG. 1 or, if desired, may have a hyperbolic contour for providing even sharper IR focussing of the deflected IR beam from beam splitter 22 onto reflecting mirror 28. The cross marks 34 represent very thin cross shaped slots cut into the dielectric surface 36 of beam splitter 22. Details of the cross shaped slots are shown in the blown up sectional view of FIG. 4. Slots 34 must be in a cross configuration to allow polarization diversity at MMW. The optimum dimension or cut of these crosses occurs when the length of each slot is equal to a half wavelength at MMW and the width is as thin as possible in diameter. However, adjacent crosses do not contact each other but are as close as possible for optimum performance. The thinness of the metal slots maintains uniform illumination intensity across the aperture, which results in improved antenna efficiency and reduced spill-over losses. Alternatively, metallic squares that have a length on each side equal to 1/10 of a wavelength at millimeter waves can also be mounted in an array fashion similar to the slot cut crosses. The metallic squares are embedded in a support material that is transparent to MMW energy. Support material may be quartz or a polytetrafluoroethlene such as Teflon. Teflon, a synthetic resin polymer, is a Trademark belonging to E. I. duPont de Nemours and Company. Other viable beam splitter materials may be used, dependent upon the infrared wavelength of incident radiation anticipated.

The electromagnetic transmission guide 10 comprising beam splitter 22, reflector 28 and lenses 30 and 26, and radome 16 provides a dichroic antenna/aperture assembly that provides both dual mode reception of millimeter wave and infrared wave energy and subsequent separation of the infrared from the millimeter waves within the common sensor aperture.

While the system has been described with emphasis on reception of incoming radiation, it is apparent that radiation can be directed in the opposite direction through the system with the antenna/aperture functioning as a transmitting system as well as a receiving system. In continuous transmit-receive optical communication systems, high data rates can be handled. Inputs or outputs from an optical system are well established in the art and since the invention does not involve these areas such are not disclosed.

A related dual mode s is disclosed in a copending application Ser. No. 708,124, filed Mar. 4, 1985, entitled "Dual Mode Antenna/Aperture" filed by J. A. Saffold, A. H. Green, Jr., and R. C. Passmore. This copending application was filed simultaneously with the subject application by applicants and is assigned to the U. S. Government as represented by the Department of the Army.

Although the present invention has been described with reference to a preferred embodiment, workers skilled in the art will recognize that changes may be made in form and detail without departing from the spirit and scope of the foregoing disclosure. Accordingly, the scope of the invention should be limited only by the claims appended hereto.

We claim:

1. A dual mode antenna/aperture system comprising: a first elongated tubular member having first and second terminal ends, a second elongated tubular member having first and second terminal ends and disposed parallel with and adjacent to said first tubular member, respective first ends having a common edge joined together and respective second ends having a common edge joined together, a beam splitter disposed in said first end of said first tubular member and a reflecting mirror disposed in said first end of said second tubular member, both said beam splitter and said reflecting mirror being responsive to a predetermined wavelength of electromagnetic radiation for reflecting said radiation through said second tubular member, and said beam splitter being transparent to a second electromagnetic radiation wavelength for passing said second wavelength therethrough into said first tubular member.

2. A dual mode antenna/aperture system as set forth in claim 1 and further comprising a radome covering respective first ends of said first and second tubes and said beam splitter for passing desirable electromagnetic radiation impinging thereon into the first end of said second tube while sealing both tubes from external environment.

3. A dual mode antenna/aperture system as set forth in claim 2 and further comprising a cassegrainian optics system having at least a primary reflector and a hyperbolic subreflector, said primary reflector having an aperture therein and being disposed adjacent the first end of said second tubular member for collecting impinging electromagnetic radiation and directing said radiation toward said subreflector; said subreflector, primary reflector aperture, radome, and said second tubular member being in substantually coaxial alignment, and said subreflector being positioned for redirecting energy incident thereon from said primary reflector toward said aperture in said primary reflector, through the radome, and into the first end of said second tubular member.

4. A dual mode antenna/aperture system as set forth in claim 3 wherein respective first ends of said first and second tubes are widened for presenting a single, circular opening that adjoins said radome, said radome being disposed in the aperture of said primary reflector.

5. A dual mode antenna/aperture system as set forth in claim 4 wherein said beam splitter is dichroic.

6. A dual mode antenna/aperture system as set forth in claim 5 wherein said dichroic beams splitter comprises a metallic plate having an array of vertical and horizontal slots cut therein to form crosses, each slot having a length equal to one-half of the length of the longest wavelength of electromagnetic radiation to be passed therethrough.

* * * * *